US007717147B2

(12) United States Patent
Milton

(10) Patent No.: US 7,717,147 B2
(45) Date of Patent: May 18, 2010

(54) APPARATUS FOR REFURBISHING USED CORES FOR ROLLS OF MATERIAL

(75) Inventor: Peter George Milton, Gillingham (GB)

(73) Assignee: Y88 Product Development Limited, Surrey (GB)

( * ) Notice: Subject to any disclaimer, the term of this patent is extended or adjusted under 35 U.S.C. 154(b) by 1038 days.

(21) Appl. No.: 10/579,367

(22) PCT Filed: Sep. 23, 2004

(86) PCT No.: PCT/GB2004/004069

§ 371 (c)(1),
(2), (4) Date: May 15, 2006

(87) PCT Pub. No.: WO2005/028353

PCT Pub. Date: Mar. 31, 2005

(65) Prior Publication Data

US 2007/0000438 A1 Jan. 4, 2007

(30) Foreign Application Priority Data

Sep. 23, 2003 (GB) ..... 0322259.3

(51) Int. Cl.
*B32B 41/00* (2006.01)

(52) U.S. Cl. ..... 156/360; 156/378; 156/584; 242/558; 242/559; 242/560; 242/560.1

(58) Field of Classification Search ..... 118/663, 118/238; 156/584, 360, 378; 242/558, 559, 242/560, 560.1
See application file for complete search history.

(56) References Cited

U.S. PATENT DOCUMENTS 3,579,381 A 5/1971 Bailey et al.
4,298,173 A * 11/1981 Johansson ..... 242/558

FOREIGN PATENT DOCUMENTS

| | | | |
|---|---|---|---|
| DE | 30 30 845 A | | 3/1981 |
| GB | 2 105 688 A | | 3/1983 |
| GB | 2333207 A | * | 7/1999 |
| JP | 7 000934 A | | 1/1995 |

* cited by examiner

*Primary Examiner*—George R Koch, III
(74) *Attorney, Agent, or Firm*—Iandiorio Teska & Coleman

(57) ABSTRACT

Apparatus (2) for refurbishing used cores (4) for rolls of material, which apparatus comprises: stripper means (6) for stripping remaining material (8) from the used cores (4); feed means (10) for feeding the used cores (4) to the stripper means (6); cleaning means (12) for cleaning the used cores (4) after they have been treated by the stripper means (6); and adhesive applicator means (14) for applying adhesive to the used cores (4) whereby the used cores (4) are then ready for re-use as refurbished cores for new rolls of material.

17 Claims, 2 Drawing Sheets

APPARATUS FOR REFURBISHING USED CORES FOR ROLLS OF MATERIAL

Figure 1:
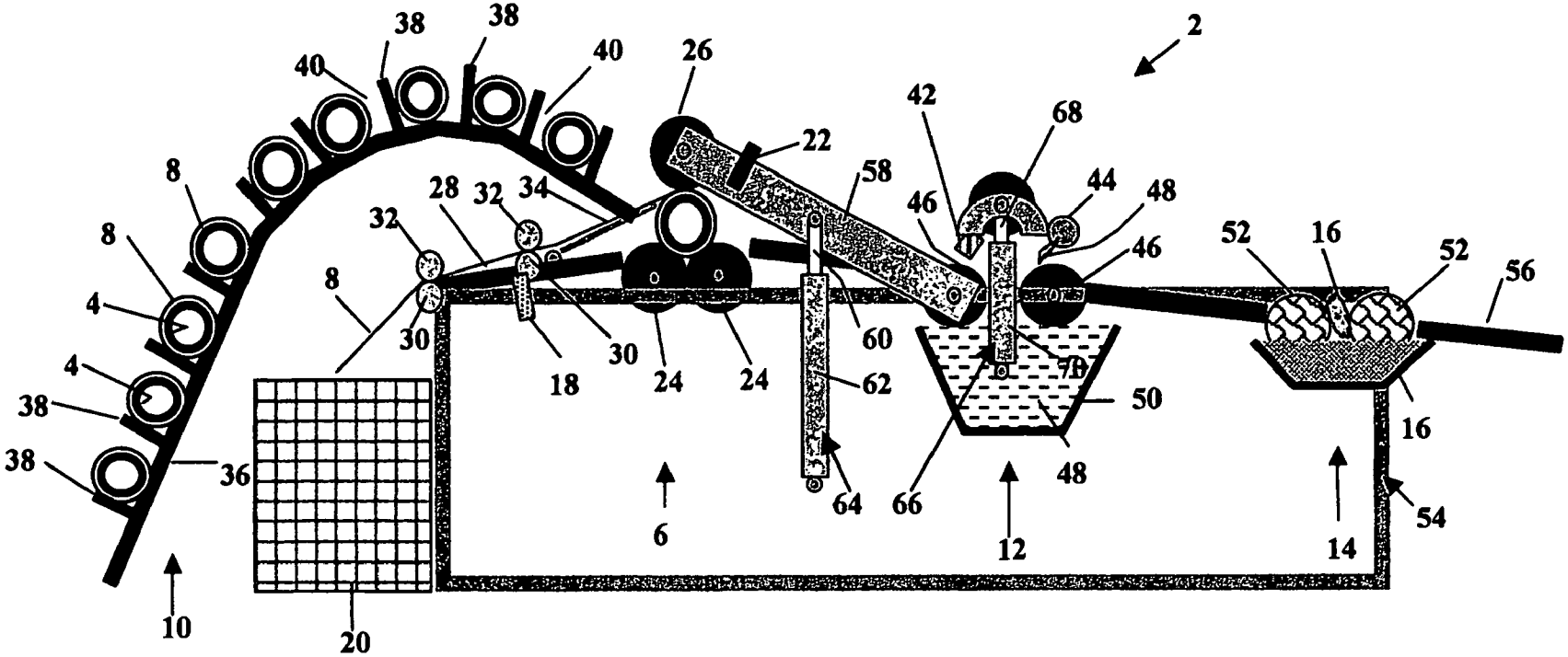

This application is a national stage entry of PCT/GB04/04069, filed Sep. 23, 2004.

This invention relates to apparatus for refurbishing used cores of material. The material may be printing paper for the printing industry or other material for other industries.

Cores for rolls of material have traditionally been thrown away after the material on the core has been used up. The cores that are used in industry are often of a large size and/or are such that their production represents a significant cost item. The disposal of the cores is wasteful, both in terms of the need to dispose of the old cores, and in terms of the need to provide new cores. In addition, in the printing industry, developments in technology have provided reel tracking systems for tracking the rolls of paper as they progress from paper mills to warehouses, docks, customer paper stores and printing machines. These tracking systems involve tagging the cores with identity tags. The identity tags are a significant cost item, and users are not satisfied at having to pay for the cost of the identity tags if they are thrown away with the used cores when the printing paper on the cores has been used up.

It is an aim of the present invention to reduce the above mentioned problems.

Accordingly, the present invention provides apparatus for refurbishing used cores for rolls of material, which apparatus comprises:

- stripper means for stripping remaining material from the used cores:
- feed means for feeding the used cores to the stripper means;
- cleaning means for cleaning the used cores after they have been treated by the stripper means;
- adhesive applicator means for applying adhesive to the used cores whereby the used cores are then ready for re-use as refurbished cores for new rolls of material; and
- sensor means for measuring and recording the length of the material stripped from each used core.

The cores are preferably made of a plastics material. The cores may be made of other suitable and appropriate materials, for example plastics materials and treatable cardboard. The material on the cores may be any suitable and appropriate material including printing paper, wallpaper, cardboard, plastics film, foil or fabric. The plastics film may be for use in the wrapping industry. The foil may be made of a plastics material or a metal, for example aluminium. The fabric may be for use as clothing, cloth or curtains.

The sensor means preferably measures in metric units so that the sensor means may measure in meters and/or millimeters. If desired however the sensor means may measure in imperial units so that the sensor means may then measure in feet and inches.

The apparatus may include a waste bin or a pallet for receiving the material stripped from each used core.

The apparatus advantageously includes tag reader means for reading identity tags, there being one identity tag on each used core. The apparatus may then be one in which the identity tags are radio frequency identity tags, and in which the tag reader means is adapted to read the radio frequency identity tags. The tag reader means thus enables the identification of each used core. Remaining material that was on each used core can then be identified, along with other information on the progress of each core during the life of its roll of material, for example from a paper mill to a warehouse, docks, a customer paper store and eventually to a printing machine.

The stripper means may comprise rollers for rotating the cores, end-obtaining means for obtaining a free end of the remaining material on each used core, and pull means for pulling the remaining material off each used core. Other types of stripper means may be employed if desired. The stripper means may be a single unit or a plurality of units arranged in line.

The rollers for rotating the cores are preferably a pair of reversible drive rollers. The end-obtaining means is preferably a roller. The end-obtaining means in the form of the roller may rotate in an opposite direction to a direction of rotation of each one of the used cores by the rollers for rotating the cores. The end-obtaining means in the form of the roller is preferably a brush roller. Rollers having other types of surfaces for picking up the free-end of the remaining material on each used core may be employed.

The feed means is preferably a conveyor feed means. Other types of feed means may be employed so that, for example, the feed means may be a hopper feed means.

The cleaning means is preferably a roller cleaning means. Other types of cleaning means may however be employed.

Preferably, the roller cleaning means has at least one scrubbing roller, and a wash station. Preferably, the apparatus is one in which there are more than one of the scrubbing rollers, and in which the wash station is a hot wash station. The wash station preferably includes a container for containing cleaning water.

The adhesive applicator means preferably comprises at least one roller for applying the adhesive. Preferably there are two of the rollers for applying the adhesive. The adhesive applicator means may also include a container for containing the adhesive. Other types of adhesive applicator means that do not use rollers may be employed if desired so that, for example, the adhesive applicator means may be a spray adhesive applicator means.

Figure 2:
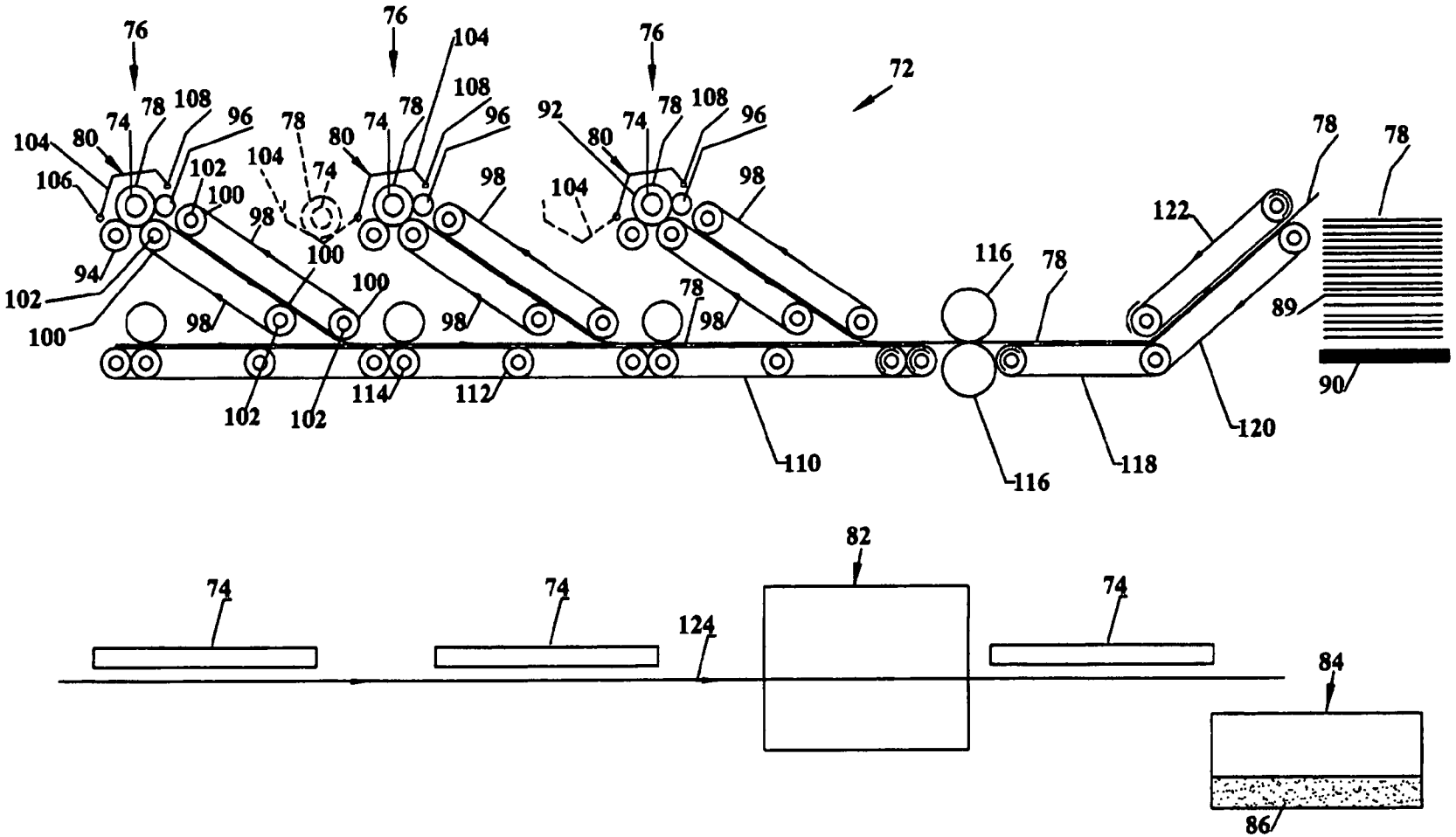

Embodiments of the invention will now be described solely by way of example and with reference to the accompanying drawings in which:

FIG. 1 shows first apparatus for refurbishing used cores for rolls of material; and FIG. 2 shows second apparatus for refurbishing used cores for rolls of material.

Referring to FIG. 1, there is shown apparatus 2 for refurbishing used cores 4 for rolls of material in the form of printing paper. The apparatus 2 comprises stripper means 6 for stripping remaining printing paper 8 from the used cores 4. The apparatus 2 further comprises feed means 10 for feeding the used cores 4 to the stripper means 6. Cleaning means 12 is provided for cleaning the used cores 4 after they have been treated by the stripper means 6. Adhesive applicator means 14 is provided for applying adhesive 16 to the used cores 4, whereby the used cores 4 are then ready for re-use as refurbished cores for new rolls of printing paper.

The apparatus 2 includes sensor means 18 for measuring and recording the length of the printing paper 8 stripped from each used core 4. The sensor means 18 measures the length of the printing paper 8 in meters.

The apparatus 2 also includes a waste bin 20 for receiving the printing paper 8 stripped from each used core 4. The printing paper 8 in the waste bin 20 is then available for re-use or disposal as may be suitable and appropriate.

The apparatus 2 further includes tag reader means 22 for reading identity tags (not shown). There will be one identity tag on each used core 4. The identity tags are radio frequency identity tags. The tag reader means 22 is adapted to read the radio frequency identity tags. Thus each used core 4 can be individually identified. Particulars applicable to that core such for example as the amount of printing paper 8 remaining on the core, and the passage of the entire roll of printing paper supported on the used core from a paper mill to a printing press can be logged.

The stripper means 6 comprises two rollers 24 for rotating the used cores 4. The two rollers 24 are reversible drive rollers 24. The stripper means further comprises end-obtaining means in the form of a roller 26. The roller 26 obtains a free-end of the remaining printing paper on each used core 4. The roller 26 is a brush roller.

The stripper means 6 further comprises pull means 28 for pulling the remaining printing paper 8 off each used core 4. The pull means 28 comprises two pairs of rollers 30, 32 as shown. A transfer arm 34 helps to transfer the free end of the printing paper 8 from the used core 4 being treated by the rollers 24 to the rollers 30.

The feed means 10 is a conveyor feed means 10 as shown. The conveyor feed means 10 comprises a conveyor 36 and dividers 38 for forming compartments 40. There is one compartment 40 for each used core 4 as shown.

The cleaning means 12 is a roller cleaning means 12. The roller cleaning means 12 has scrubbing rollers 42 and a hot wash station 44. Two support rollers 46 support the used cores 4 one at a time as they pass through the cleaning means 12. The support rollers 46 are then able to move the cleaned used cores 4 to the adhesive applicator means 14. Hot water 48 from the hot wash station 44 is collected in a container in the form of a tray 50.

The adhesive applicator means 14 comprises a pair of rollers 52 for applying the adhesive 16 to the cores 4. The cores 4 then become refurbished cores ready for receiving new rolls of paper.

The apparatus 2 may be such that the various parts are mounted on a frame 54. Refurbished cores may leave the apparatus 2 via a sloping outlet 56. The rollers 26, 46 may be supported as shown on a pivoting arm 58 mounted on a piston 60. The piston 6 operates in a cylinder 62 of a hydraulic lifter 64. A similar but smaller hydraulic lifter 66 having a piston 68 operating in a cylinder 70 supports the scrubbing rollers 42 and the hot wash station 48.

Referring now to FIG. 2, there is shown apparatus 72 for refurbishing used cores 74 for rolls of material in the form of printing paper. The apparatus 72 comprises stripper means 76 for stripping the remaining paper 78 from the used cores 74. The apparatus 72 further comprises feed means 80 for feeding the used cores 74 to the stripper means 76. Cleaning means 82 is provided for cleaning the used cores 74 after they have been treated by the stripper means 76. Adhesive applicator means 84 is provided for applying adhesive 86 to the used cores 74, whereby the used cores 74 are then ready for re-use as refurbished cores for new rolls of printing paper.

The apparatus 72 may include sensor means (not shown) for measuring and recording the length of the printing paper 78 stripped from each used core 74. The sensor means may measure the length of the printing paper 78 in metres or yards as may be required.

The apparatus 72 is such that cut printing paper 78 is provided as a stack 89 on a pallet 90. The printing paper 78 on the pallet 90 is then available for re-use or disposal as may be suitable and appropriate.

The apparatus 72 further includes tag reader means 92 for reading identity tags (not shown). There will be one identity tag on each used core 74. The identity tags are radio-frequency identity tags. The tag reader means 92 is adapted to read the radio-frequency identity tags. Each used core 74 can then be individually identified. Particulars applicable to that core such for example as the amount of printing paper 78 remaining on the core, and the passage of the entire roll of printing paper supported on the used core from a paper mill to a printing press can be logged.

The stripper means 76 comprises a plurality of in-line stripper means 76. There may be, for example, from two-ten of the stripper means 76. In FIG. 2, three of the stripper means 76 have been shown. Each stripper means 76 comprises a roller 94 and a brush roller 96. The brush roller 96 acts to feed paper 78 (shown only in the two right hand stripper means 76 as shown in FIG. 2) through a pair of endless conveyor belts 98. The conveyor belts 98 rotate in the direction of the illustrated arrows on rollers 100. The rollers 100 are mounted on bearings 102.

The feed means 80 is a container 104 which pivots about a pivot 106 from a core load position shown by the container 104 being in broken lines, to a running position shown by the container 104 being in solid lines. The used cores 74 with their printing paper 78 may be side loaded into the container 104. This may be done manually, for example by hand or using an appropriate loading machine. Pivoting of the container 104 from the load position shown in the broken lines to the running position shown in the full lines may be effected by a pneumatic or hydraulic device (not shown). A stop 108 is employed for ensuring that the paper cannot come out from above the brush roller 96.

The paper from the conveyor belts 98 passes onto a main web conveyor belt 110 which is supported on rollers 112 mounted on bearings 114. The paper 78 then passes between cutting and stitch cylinders 116. A blade (not shown) mounted on one of the cylinders 116 cuts the paper 78. The cut paper 78 then passes onto the conveyor belt 118 and then between conveyor belts 120, 122 where it emerges as cut sheets 78 for the stack 89.

As shown in FIG. 2, the used cores 74 which have been stripped of paper are fed, for example manually, to a core conveyor 124. The cores then pass to the cleaning means 82 which is an in-line core washer. The washed cores 74 then pass to the adhesive applicator means 84.

The used cores 4 used in the apparatus of the present invention are made of a material suitable for being refurbished by the apparatus. Thus, for example, the used cores may be made of a plastics material. The used cores may comprise a body portion, a bore through the body portion, a first end member which is removably secured to a first end of the body portion, and a second end member which is removably secured to a second end of the body portion. The cores can each be provided with an identity tag such as a radio frequency identity tag. The identity tags are able to be recycled with the cores, and thus wastage of cores in throwing them away is avoided. If handling of a roll of paper should cause the first end member and the second end member to become damaged, then the damaged member can easily be replaced while still retaining the remainder of the core. The core may be one in which the first end member is inserted into the bore at the first end of the body portion, and in which the second end member is inserted into the bore at the second end of the body portion. The core may be one in which the first end of the body portion receives an insert portion on the first end member, and in which the second end of the body portion receives an insert portion on the second end member. The first end member may be a push-in friction fit in the first end of the body portion, and the second end member may be a push-in friction fit in the second end of the body portion.

It is to be appreciated that the embodiments of the invention described above with reference to the accompanying drawings have been given by way of example only and that modifications may be effected. Thus, for example, different types of stripper means 6, cleaning means 12 and adhesive applicator means 14 to those shown in the drawings may be employed. The cores for may be for rolls of material other than printing paper.

The invention claimed is:

1. Apparatus for refurbishing used cores for rolls of material, which apparatus comprises:

stripper means for stripping remaining material from the used cores;

feed means for feeding the used cores to the stripper means;

cleaning means for cleaning the used cores after they have been treated by the stripper means;

adhesive applicator means for applying adhesive to the used cores whereby the used cores are then ready for re-use as refurbished cores for new rolls of material; and sensor means for measuring and recording the length of the material stripped from each used core.

2. Apparatus according to claim 1 in which the sensor means measures in metric units.

3. Apparatus according to claim 1 and including a waste bin or a pallet for receiving the material stripped from each used core.

4. Apparatus according to claim 1 and including tag reader means for reading identity tags, there being one identity tag on each used core.

5. Apparatus according to claim 4 in which the identity tags are radio frequency identity tags, and in which the tag reader means is adapted to read the radio frequency identification tags.

6. Apparatus according to claim 1 in which the stripper means comprises rollers for rotating the used cores, end-obtaining means for obtaining a free end of the remaining material on each used core, and pull means for pulling the remaining material off each used core.

7. Apparatus according to claim 6 in which the rollers for rotating the core are a pair of reversible drive rollers.

8. Apparatus according to claim 6 in which the end-obtaining means is a roller.

9. Apparatus according to claim 8 in which the roller is a brush roller.

10. Apparatus according to claim 1 in which the feed means is a conveyor feed means.

11. Apparatus according to claim 1 in which the cleaning means is a roller cleaning means.

12. Apparatus according to claim 11 in which the roller cleaning means has at least one scrubbing roller, and a wash station.

13. Apparatus according to claim 12 in which there are more than one of the scrubbing rollers, and in which the wash station is a hot wash station.

14. Apparatus according to claim 12 in which the wash station includes a container for containing cleaning water.

15. Apparatus according to claim 1 in which the adhesive applicator means comprises at least one roller for applying the adhesive.

16. Apparatus according to claim 15 in which there are two of the rollers for applying the adhesive.

17. Apparatus according to claim 15 and including a container for containing the adhesive.

* * * * *